United States Patent [19]

Laursen et al.

[11] Patent Number: 4,640,810

[45] Date of Patent: Feb. 3, 1987

[54] SYSTEM FOR PRODUCING AN AIR LAID WEB

[75] Inventors: Henning Laursen, Aarhus; John Mosgaard, Risskov; Otto V. Nielson, Aarhus, all of Denmark; Clark L. Poland, New Canaan, Conn.

[73] Assignee: Scan Web of North America, Inc., New Canaan, Conn.

[21] Appl. No.: 619,946

[22] Filed: Jun. 12, 1984

[51] Int. Cl.[4] ..... B27N 1/00

[52] U.S. Cl. ..... 264/518; 264/121; 425/80.1; 425/83.1

[58] Field of Search ..... 264/121, 517, 518; 425/80.1, 83.1

[56] References Cited

U.S. PATENT DOCUMENTS

| | | | |
|---|---|---|---|
| 2,931,076 | 4/1960 | Clark | 264/121 |
| 2,940,134 | 6/1960 | Heritage | 425/83.1 |
| 2,990,004 | 6/1961 | Sowers et al. | 264/121 |
| 3,010,161 | 11/1961 | Duvall | 264/121 |
| 3,145,430 | 8/1964 | Caron | 425/83.1 |
| 3,482,287 | 12/1969 | Flewwelling | 264/121 |
| 3,834,869 | 9/1974 | Ancelle et al. | 264/121 |
| 4,335,066 | 6/1982 | Dinius | 264/121 |
| 4,350,482 | 9/1982 | Alexandrov et al. | 264/121 |
| 4,352,649 | 10/1982 | Jacobsen et al. | 425/83.1 |
| 4,375,448 | 3/1983 | Appel et al. | 264/121 |

FOREIGN PATENT DOCUMENTS

| | | | |
|---|---|---|---|
| 02031 | 7/1981 | PCT Int'l Appl. | 425/80.1 |

*Primary Examiner*—Donald Czaja
*Assistant Examiner*—Mary Lynn Fertig
*Attorney, Agent, or Firm*—Roland T. Bryan

[57] ABSTRACT

A system for forming an air laid web of fibers and/or particles on a moving foraminous carrier. Fibers and/or particles are blended, and while supported in an air stream, introduced into a distributor unit. The distributor unit includes a rotatable cylinder formed with classification apertures of a predetermined shape, number, and size as specifically related to the types of fibers and/or particles utilized. A rotatable shaft with radially extending wire-like members agitates the fibers and/or particles and throws them outwardly through the apertures. Downwardly directed air flow transports the refined fibers and/or particles so as to form a homogeneous, still further refined, web on the surface of the carier. A variety of adjustments and alternations can be made to the system and its components to control the composition and thickness of the end product, and to attain maximum capacity for any combination of fibers and/or particles.

44 Claims, 15 Drawing Figures

SYSTEM FOR PRODUCING AN AIR LAID WEB

BACKGROUND OF THE INVENTION

1. Field of the Invention

The present invention relates generally to air forming systems, that is, to systems for forming an air laid web on a moving foraminous surface and, more particularly, to systems for uniformly distributing fibers and/or particles to form a web of a predetermined composition. The result is a superior nonwoven product.

2. Description of the Prior Art

From a commercial standpoint, air forming is a relatively young technology and is now finding its way into a wide variety of uses. In most cases, the driving forces for this new and flexible technology have been improved product performance, reduced costs, operating flexibility and environmental considerations. Examples of commercial products that are being produced via air forming which are cost effective and/or embody superior product performance include industrial wipers, disposable hospital underpads, disposable tablecloths and napkins, pre-moistened baby wipes, and adult diapers. Furthermore, as the marketplace demands improved performance and/or reduced costs, it is logical to expect more and better air formed products to appear on the scene.

Some of the economic aspects of air forming which make it attractive include: (1) the ability to locate manufacturing facilities close to the marketplace; (2) economically viable yet smaller units of capacity which result in more moderate capital costs; (3) the simplicity of the operation itself; and (4) the ability to use low cost recycled fiber of the type which can be collected close to the plant site.

According to a simplified description of a conventional air forming process, fibers are carried to a forming head within an airstream generated by transport fans. The raw materials, either virgin or recycled fibers, have been reduced to their fiber form in a hammermill or similar grinding device. By means of a suction box positioned beneath a moving foraminous surface, the fibers carried in the airstream are drawn downwardly onto the surface to form a fibrous web. A suitable binder is added to the fibers at some stage of the process, then cured or otherwise acted upon to impart integrity to the fibrous web. The resulting web can then be treated or converted in various ways to achieve the desired end product.

The growth of air forming has been stimulated by the strengths and limitations of a variety of industries and their influences have affected both product and process advances. Those industries which have had a particularly significant influence on the development of air forming are paper making, textiles, and nonwovens. Being a very mature technology, and utilizing very capital intensive equipment, the papermaking industry has traditionally placed a heavy emphasis on line speed. Since some of the early air forming systems were commercialized by papermaking companies, the technology benefited from the papermakers' bias toward faster and faster line speeds. Additionally, papermakers are particularly fortunate in that they utilize a very low cost raw material, namely, wood pulp. The early use of this low cost raw material in air formed products has been a substantial aid in penetrating new and different markets.

Textile manufacturers have, in effect, set the product standards in areas such as hand, drape and porosity against which nonwoven products are to be measured. Furthermore, the textile and chemical industries have developed a wide array of synthetic fibers which offer improved strength, resistance to rot, ability to be dyed, and ease of being bonded together. Generally speaking, these synthetic textile-type fibers can only be handled by traditional carding, garnetting and other quite mature processes. On the negative side, textile line speeds are slow by the standards of papermaking or nonwoven manufacturing. As a result of the process and product flexibility of air forming systems, nonwovens are now in competition with conventional textile production machinery for the manufacture of products such as disposable generating gowns, surgeon's hand towels, and cubicle curtains.

The major influence of nonwovens on air forming has essentially been twofold. First, the remarkable overall growth in worldwide nonwoven volume has served to stimulate the interest of manufacturers seeking new and better ways to make nonwoven fabrics. Second, the continuing demand for better cost and performance requirements for fabrics within the nonwoven market has led to increasing interest in the flexibility of air forming systems.

The air forming process thus exhibits a number of distinct commercial benefits. Some of the more significant of these are as follows:

Optimum Use of Raw Materials

Air forming systems can be designed to optimize the use of increasingly costly raw materials. For example, a "sandwich" structure can be laid down on the forming surface or wire with high cost and high performance materials on the outside and low cost filler materials on the inside.

Environmental Considerations

Generally speaking, air forming is a relatively "clean" process and does not present major water pollution, stack gas, chemical waste, or in-plant pollution problems.

Economics

The capital cost per annual weight of output favors air forming over other nonwoven processes. Particularly in the case of high bulk, blended or composite webs, smaller units of capacity appear to be economically viable. This permits management to better balance market growth with capacity and capital requirements. Also, reduced transportation costs for recycled fiber and for the end product can be achieved due to the flexibility of locating air forming lines close to the raw materials and to the marketplace.

Simplicity

Air forming technology has been moving in the direction of more simply constructed and easier-to-operate systems. Present air forming systems do not require highly skilled operators and are relatively easy to start up and shut down.

Overall Line Flexibility

Central to the concept of air forming systems is the ability to design and utilize system components to do a variety of tasks. In addition to the ability of air forming systems to produce sandwich type structures and to use recycled fibers as noted above, air forming lines have, for example, been designed to:

(a) combine air forming with carded webs;
(b) produce feminine hygiene products, filter media, and saturating grades of paper; and
(c) add uniformity and bulk to spunbound fabrics.

Bonding Flexibility

Nonwoven materials require a variety of bonding approaches depending upon the desired end use of the fabric. The most common bonding options for nonwovens include spray, saturation, foam, and thermal bonding and most of these are compatible with the air forming process. However, today, the most commonly used method for light and medium air formed fabrics is the spraying of a latex emulsion onto both sides of the fabric.

Those patents which are generally exemplary of the prior art with respect to apparatus and methods relating to air forming and to nonwoven products manufactured by air forming machinery or by some other type of machinery will now be presented.

These are numerous patents directed to systems for distributing an air laid layer of fibers on an advancing foraminous surface. Some of the more recent patents within this group are those U.S. Patents to Dinius et al., No. 4,366,111; to Hosler et al., No. 4,353,686; to Day, Nos. 4,351,793 and 4,264,289; to Jacobsen et al., No. 4,352,649; to Alexandrov et al., No. 4,350,482; to Persson, Nos. 4,278,113 and 4,157,724; to Widnall, No. 4,276,248; to Dunkerly, II et al., No. 4,264,290; and to Werner, No. 4,258,455. While numerous concepts are presented in these patents, the goal sought by each of the methods or constructions disclosed is to achieve, in a resulting product, uniformity of texture and smoothness of the outer surface. Most of the disclosures are concerned with reducing clumps of fibers into groupings of individual fibers prior to permitting them to be incorporated into a web and a variety of constructions are disclosed to assure such a result.

A number of patents disclose apparatus for forming a product having a plurality of layers. In the U.S. Patent to Buell, No. 4,217,078, machinery is disclosed for continuously forming a plurality of layers of air laid fibrous fluff webs between reinforcing plies composed of paper which are substantially impervious to the passage of fibers from one surface to the other. The U.S. Patents to Matsumura et al., Nos. 3,781,150 and 3,984,898 both disclose apparatus for forming a short fiber layer and a long fiber layer or layers simultaneously in a single stage process. Adjacent layers, in this instance, are held together by mechanical interfiber bonds at their interfaces, the result said to be a multi-layer mat product with a maximum of yield and resultant high economy.

Another group of the prior art with which applicants are acquainted is represented by the U.S. Patents to Pauls et al., No. 4,348,251 and to Kroyer, No. 3,575,749 as well as to the British published patent application to Kroyer, No. 2,015,604. These publications disclose methods and apparatus for applying a binder to a loose fibrous web to thereby impart integrity to the web. The binder material may be in the form of a liquid solution, slurry, suspension, foam, or powder and may be introduced at a variety of stages in the course of the process. The Pauls et al. patent discloses a specific device for applying a foamed layer of a bonding agent to a dry laid, loose fibrous web. The Kroyer patents disclose different methods of making fibrous webs which in some fashion apply a binder in the course of the process.

In some instances, multi-layered products are bound together by the provision of an intermediate film of thermoplastic sheet material placed between adjacent layers of absorbent core material which may be fibrous. Typical of such products are the disclosures in the U.S. Patents to Brooks et al. No. 3,683,921 and to Moore et al., No. 3,678,933. The U.S. Patents to Butterworth et al., No. 4,077,410 and to Nedwig, No. 3,990,149 disclose multi-layered products which utilize thermoplastic fiber elements in adjoining layers to bind the layers together. Specifically, the layers are compressed together with heat to produce thermoplastic softening of at least some of the fibers, the fibers in adjoining layers thereby being caused to adhere to one another.

The U.S. Patent to Ludwa, No. 4,239,792 is indicative of the properties sought in a disposable product. In this instance, the product is a device said to be suitable for cleaning and wiping hard surfaces. The product is laminated and has a core preferably of an absorbent paper web with outer layers composed of apertured nonwoven fibers. As stated, the end result is a wiping device which is strong, absorbent, will retain sufficient water after manual wringing to clean soiled surfaces while leaving the cleaned surface essentially dry.

Previously, it was stated that the most commonly used method for bonding light and medium air formed fabrics is the spraying of a latex emulsion onto both sides of a fabric. Such a method is disclosed in the Kroyer patent, No. 3,575,749 noted above. However, while this technique is reasonably well suited for lightweight, lofty, absorbent products, a drawback resides in the need to remove substantial quantities of water, often equivalent to the weight of the dry product being produced. Furthermore, loss of binder results from overspraying. Also, there is a need to continuously clean the layer forming surface, or carrier wire, in addition to the general house-keeping problems associated with the latex emulsion bonding material.

Thermal bonding provides an attractive and flexible alternative to those bonding techniques which have just been mentioned. Recently it has been found that stronger and better performing nonwoven fabrics can be made by mixing relatively long thermoplastic fibers uniformly with wood pulp fibers and then activating the thermoplastic fibers by applying heat and/or pressure. A particular benefit thereby achieved is that the bonding and consolidation process is completely dry, which is indeed a primary advantage of air forming systems in general. Furthermore, by incorporation of thermal bonding fibers, the air forming process itself can be made simpler, more compact, and more energy efficient.

A prerequisite, however, for employing the thermal bonding technique is the ability to form a homogeneous web composed of a mixture of two or more different constituent fibers, particularly where these fibers may differ appreciably in length, diameter, flexibility, and surface characteristics, among others. Apparatus which is particularly capable of producing air laid webs from a variety of types of fibers and particles, or any mixtures of these, and achieving commercially acceptable results is disclosed in the Jacobsen et al. patent, No. 4,352,649, cited above. The Jacobsen et al. apparatus is sometimes referred to as a "drum former", since the essential features of the system comprise a pair of generally parallel, perforated, contra-rotating drums formed of screen tubes and known as distributors of the fibers. The drums are positioned transversely above a forming wire and within a housing having a generally rectangular cross section. Semi-circular connector pipes connect the respective ends of the screen tube drums and a supply pipe intersects, in a tangential fashion, with each connector pipe. In this fashion, the screen tube drums and connector pipes form a continuous path for fibers introduced to the system. Furthermore, mounted inside each screen tube drum on an axis generally parallel with an axis of the drum is a rotatable shaft carrying a large number of radially protruding needles.

Regulating valves are mounted in the housing above the screen tube drum to control the downward flow of air. The housing itself is sealed in its longitudinal direction with side plates and in the transverse direction by means of seal rolls.

In operation, fibers and/or particles which are dispersed in air are fed into the rotating screen tube drums via the supply pipes and travel in the generally circular path defined by the screen tube drums and the connector pipes. As the fiber and/or particle stream passes through the screen tube drums, the radially protruding needles are rotated in a plane transverse to that of the fluid flow such that the needles strike the fibers and cause them to be forced through the screen of the drums. Air from a suction box positioned beneath the forming wire and generally coextensive with the housing, draws the fibers and/or particles down onto the forming wire. The continuous flow of fiber-and/or particle-laden air exiting through the screen tube drums and the connector pipes assures a uniform distribution of the fibers and/or particles on the forming wire. The formed web passes under a seal roll at the end of the forming zone, is compacted, and then transferred onto the first of a series of consolidation operations farther downstream from the drum former. One such operation may be the thermal bonding process mentioned above.

The drum former system also serves advantageously in separating out clumps of fibers, or "nits", and preventing their deposition onto the forming wire. By reason of their diversity, the nits remain on the outer wall of the region defined by the drums and connector pipes. Eventually, the fibers either pass through the holes in the drum or, if not properly defibrated or opened, they are drawn off from the drums and recycled for further mechanical treatment. By reason of this feature, if recycled wastes with imperfections are fed into the system, there is no diminution of quality of the finished product.

An additional benefit of the drum former system resides in its ability to handle fibers at least up to 25 mm in length. This feature permits the addition of a variety of fibers without modification of the system.

It was with the knowledge of the state of the art as noted above and with recognition of the continuing needs for improved products, and apparatus and processes to achieve such improved products, that the present invention was conceived and has now been reduced to practice.

SUMMARY OF THE INVENTION

To this end, the present disclosure presents a system for forming an air laid web of material on a moving foraminous carrier. The system reflects all of the advantages and benefits of air forming as mentioned above and adds a degree of flexibility and performance hitherto unknown. Fibers and/or particles are blended, and while supported in an air stream, introduced into a distributor unit. The distributor unit includes a rotatable cylinder formed with classification apertures of a predetermined shape, number, and size as specifically related to the types of fibers and/or particles utilized. A rotatable shaft with radially extending wire-like members agitates the fibers and/or particles and throws them outwardly through the apertures. Downwardly directed air flow transports the refined fibers and/or particles so as to form a homogeneous, still further refined, web on the surface of the carrier. A variety of adjustments and alterations can be made to the system and its components to control the composition and thickness of the end product, and to attain maximum capacity for any combination of fibers and/or particles.

According to a preferred embodiment of the invention, a stream of roughly graded material of at least one of first and second loose fibers and particles is introduced into a blender. Each of the types of fibers and/or particles originates at a feeding device. In the instance of cellulose fibers, the feeding device may be a hammermill, for example, and in the instance of synthetic fibers, the feeding device may be a suitable fiber opening device which operates to separate clumps of fibers into masses of individual fibers. In the instance of particles, any suitable dispenser may be used. The streams of fibers and/or particles thus introduced into the blender are mixed into a homogeneous mass within the blender with appropriate quantities of air to thereby produce an air-borne stream of roughly graded material. The homogeneous air-borne mixture is then directed to a distributor unit.

The distributor unit is physically positioned transversely above a moving foraminous carrier and comprises a pair of interconnected receptacles positioned in a side-by-side relationship for temporarily containing the air-borne stream of roughly graded material. Within the distributor unit, the air-borne stream of roughly graded material is guided into a continuous circuitous flow. Each pair of receptacles includes a rotatable drum and stationary cup-shaped end members having cavities which communicate with the interior of the drum. Chute members located at the ends of the receptacles connect the cavities of adjacent end members to permit the circuitous flow mentioned above.

Each of the rotatable drums is provided with a plurality of classification apertures which extend through the drum around its circumference. The apertures are of a predetermined shape, number, and size as specifically related to the types of fibers and/or particles introduced to the system. To accept flow of relatively short fibers and/or particles, apertures are preferably circular, have a diameter substantially equivalent to the length or size of the fibers and/or particles introduced into the system, and are large in number per unit length of the drum. To accept flow of relatively long fibers, or of blends of long and short fibers and/or particles, apertures are preferably rectangular with a length generally double that of the long fibers and a width generally ten times the diameter of the fibers. Because the rectangular apertures are larger than the circular apertures, their number is moderate per unit length of the drum in comparison to the circular apertures.

The system also includes, within each receptacle, a rotatable shaft having an axis generally parallel to the axis of the drum and having a plurality of wire-like members extending radially from the shaft. As the result is rotated in a direction opposite that of its associated drum, the wire-like members engage individual fibers and/or particles and fling them through the apertures in the drum. Simultaneously, the wire-like members rotationally agitate the fibers and/or particles to maintain the homogeneous mixture first achieved in the blender. The shaft can be moved to adjust the distance between the tips of the wire-like members and the interior surface of the drum. Generally, the closer the wire-like members are to the wall of the drum, the more effective is the system is delivering longer fibers and/or particles onto the carrier and the greater the capacity of the system for fibers and/or particles of all lengths.

Additionally, the rotational speeds of the drum and of the shaft with wire-like members are independently variable. This results in a high degree of flexibility in that the system can operate with a wide range of sizes and shapes of fibers and/or particles and simultaneously achieve an optimum capacity or mass flow rate for the web being formed.

A suction box is positioned beneath the foraminous carrier, generally coextensive with the distributor unit. The suction box causes a downwardly directed flow of air which serves to direct the flow of the air-borne stream of the fibers and/or particles, after passing through the classification apertures, to be deposited upon the surface of the carrier. The resulting web deposited on the carrier is a refined composition of the same homogeneous mixture first achieved in the blender and maintained throughout the process.

A withdrawal conduit extends from the downstream end of each of the receptacles and is connected to the feeding devices. It serves to withdraw from the receptacles those fibers and/or particles which have not passed through the classification apertures during their circuitous flow. It is likely that the failure of fibers and/or particles to pass through the apertures is a result of their being clumped together or otherwise exhibiting an unsuitable condition for passing through the apertures. In this way, unsuitable fibers and/or particles are returned to the feeding device for further processing to render them acceptable for a subsequent pass through the system.

An air flow conductor generally surrounds the receptacles above the carrier and is generally coextensive with the suction box. The conductor is open at its upper and lower ends and serves to direct the flox of air caused by the suction box downwardly, past the receptacles, and through the carrier. A lower edge of the conductor which extends across the carrier at a downstream zone at which the carrier moves beyond the reduced end is generally parallel to the surface of the carrier and spaced above the carrier by a sufficient distance to enable the web being formed on the carrier to pass through, and beyond, the conductor. In order to confine the flow of air within the conductor notwithstanding the exit opening, a cylindrical seal roll is provided which extends transverse to the direction of movement of the carrier and generally coextensive with and proximate to the opening. The seal roll is biased into engagement with the web and an adjustable counterbalance is provided to vary that pressure, as desired.

The area of deposition of the air-borne stream of fibers and/or particles onto the carrier at any given instant is approximately equivalent to the projected area of a drum. Furthermore, since the process of the system of the present invention is a continuous one, in order to achieve maximum capacity, according to a preferred embodiment, the rotational axes of the drums extend in a direction transverse to the direction of movement of the carrier. However, the invention need not be so limited. In fact, there are applications for which it is desirable that the drums extend substantially parallel to the direction of movement of the carrier. One such application might be in those instances in which the width of the desired end product is relatively narrow.

Other and further features, objects, advantages, and benefits of the invention will become apparent from the following description taken in conjunction with the following drawings. It is to be understood that both the foregoing general description and the following detailed description are exemplary and explanatory but are not restrictive of the invention. The accompanying drawings which are incorporated in and constitute a part of this invention, illustrate different embodiments of the invention and, together with the description, serve to explain the principles of the invention.

DETAILED DESCRIPTION OF THE DRAWINGS

Figure 7:
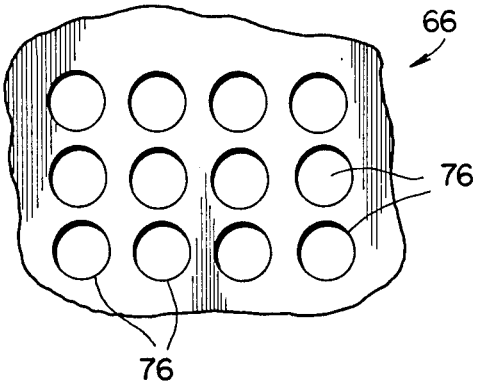
Figure 8:
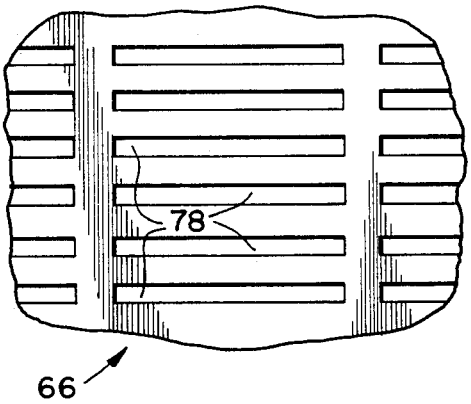
Figure 9:
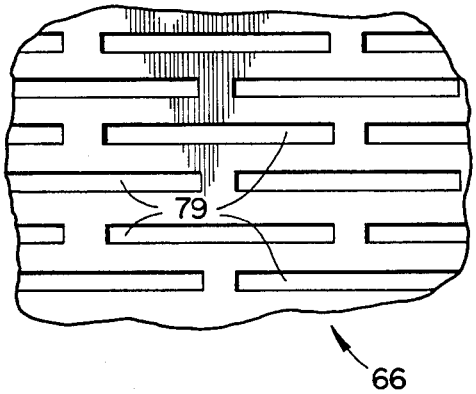
Figure 10:
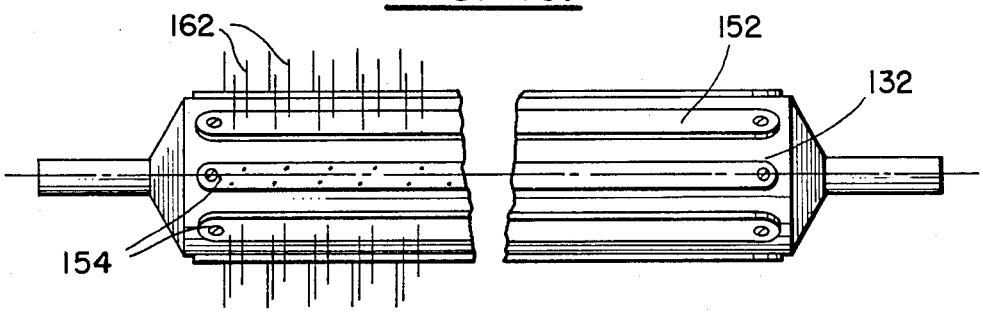
Figure 11:
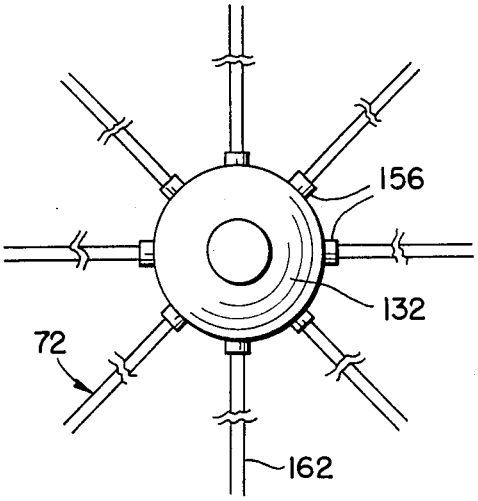
Figure 14:
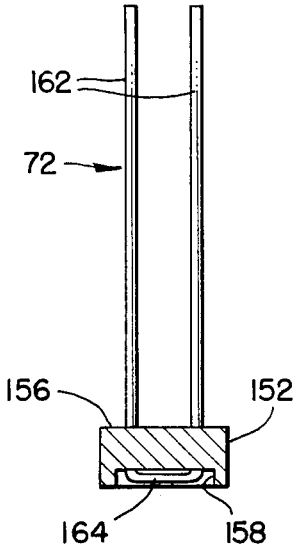
Figure 12:
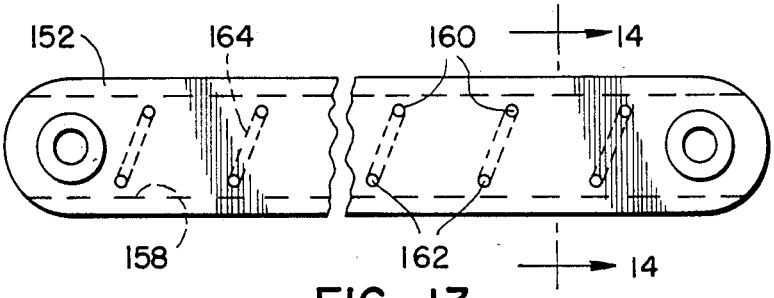
Figure 13:
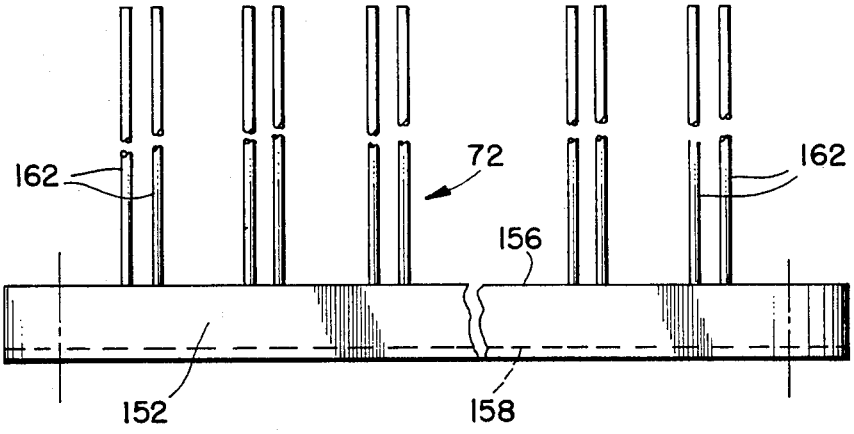

FIGS. 7, 8, and 9 are detail views, each illustrating a different embodiment of outlet or classification apertures formed in a rotatable drum which is a part of the invention;

FIG. 10 is a front elevation view of a brush roll which is another part of the invention;

FIG. 11 is an end elevation view of the brush roll illustrated in FIG. 10;

FIG. 12 is a top plan view of a part used with the brush roll illustrated in FIGS. 10 and 11;

FIG. 13 is a side elevation view of the part illustrated in FIG. 12; and FIG. 14 is a cross section view taken generally along line 14—14 in FIG. 12.

DESCRIPTION OF THE PREFERRED EMBODIMENT

Figure 1:
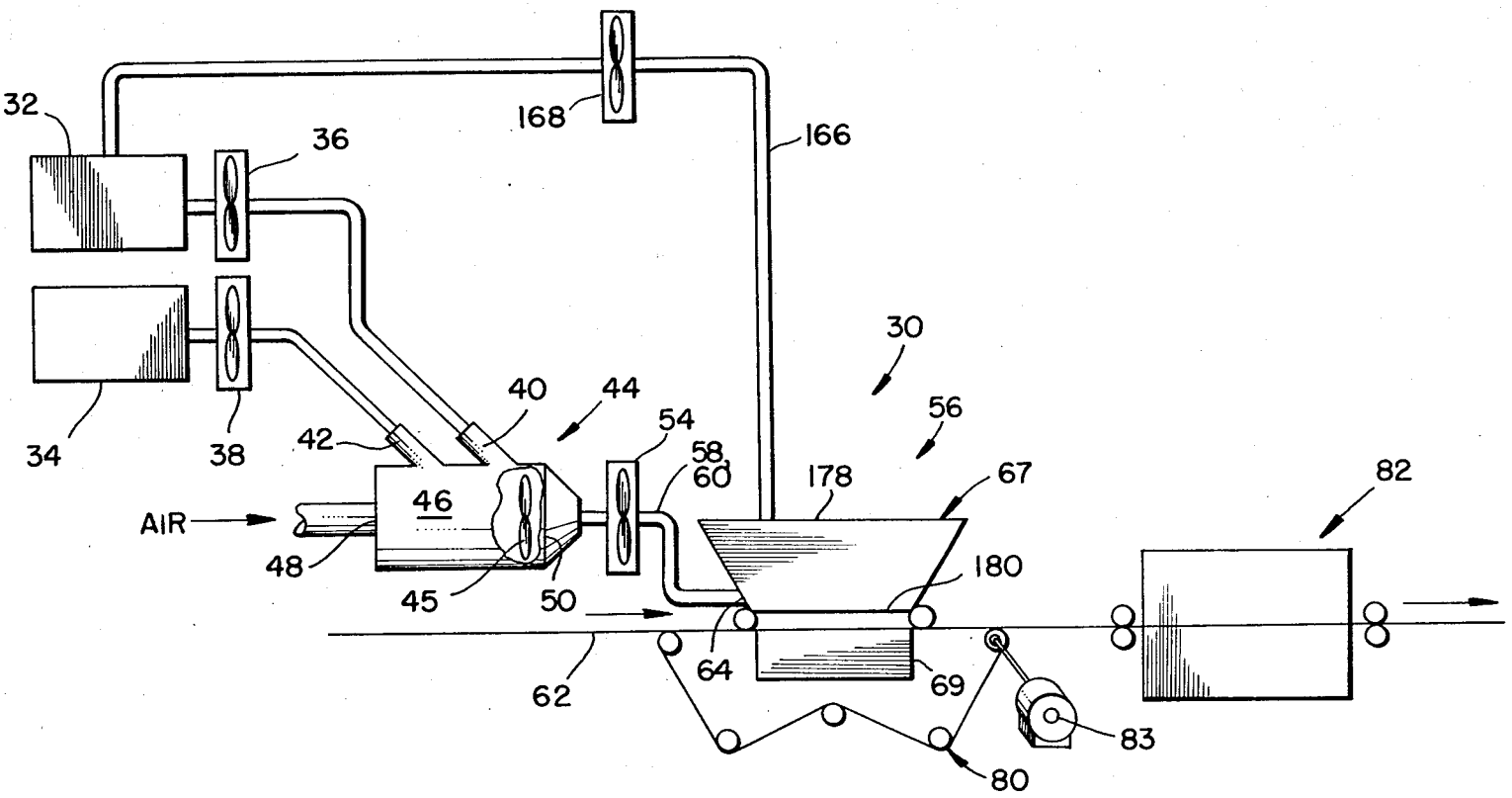
FIG. 1 is a schematic representation of an air forming system embodying the principles of the present invention.

Refer now to the drawings, and initially to FIG. 1 which is a schematic flow diagram which generally represents an air forming system 30 embodying the principles of the present invention.

In accordance with a preferred embodiment of the invention, apparatus is disclosed for forming an air laid web of material comprising: supply means forming a stream of roughly graded material of at least one of (a) first loose fibers (b) second loose fibers (c) particles and for mixing the roughly graded material with air to produce an air-borne stream thereof; distributor means forming a recirculating air-borne stream of the roughly graded material adapted to receive the air-borne stream from said supply means, said distributor means including tumbler means causing at least a portion of the recirculating stream of roughly graded material to rotate in one direction, and agitating means causing an internal portion of the recirculating stream to rotate in an opposite direction to that of said tumbler means; said tumbler means having a plurality of classification apertures extending therethrough being of a predetermined shape, number, and size as specifically related to the types of the roughly graded material introduced to said distributor means; said agitating means adapted to cause flow through the classification apertures of a first finely graded material; air flow producing means causing the first finely graded material to become a directionalized air-borne stream; and a foraminous carrier movable in a direction transverse to the directionalized air-borne stream for arresting predetermined sizes and shapes of the first finely graded material resulting in a translating arrested web of material as a second finely graded material web.

As embodied herein, the process performed by the apparatus of air forming system 30 begins with a pair of feeding devices 32 and 34 which serve as sources of roughly graded material which may be either loose fibers or particles. It will be understood, for purposes of the invention, that while only two feeding devices are illustrated, in fact, there may be any number, as desired. In any event, the devices 32 and 34 can be in the nature of a hammermill, defibrator, or other suitable device for operating on the raw material, if necessary, and delivering masses of individual fibers and/or particles to the rest of the system at a predetermined feed rate. The supply means also includes flow generators or fans 36 and 38 which appropriately deliver fibers and/or particles in any desired ratio from the feeding devices 32 and 34, respectively, to inlet ducts 40 and 42 of a blender 44. The blender itself may include a fan 45 for drawing material from the feeding devices 32 and 34 in a similar fashion.

The blender 44 is generally in the form of a cylindrical container 46 having an inlet end 48 and an outlet end 50. It is preferable that the ducts 40 and 42 are angled, as indicated in FIG. 1, toward the outlet end. In this fashion, the roughly graded material from the feeding devices 32 and 34 is introduced to a stream of air flowing from the outlet end 48 and are thoroughly mixed within the container 46. This mixing is further enhanced by the flow of the roughly graded material into a cone shaped container 52 integral with the cylindrical container 46 and communicating at its major end with the outlet end 50. The mixing process continues when the air supported fibers and/or particles are drawn from the container 52 into and through a blower 54. The blower is mounted to the minor end of the cone shaped container 52. In addition to continued mixing of the roughly graded material, the blower 54 serves to convey the roughly graded material to a distributor unit 56 by way of a pair of conduits 58 and 60.

As seen in FIGS. 2–5, the distributor unit 56 is positioned above, and extends transversely of, the direction of travel of a foraminous carrier 62 which is of any suitable design enabling fibers and/or particles to be homogeneously deposited on its upper surface, and then capable of delivering the web thus formed to a subsequent station.

The distributor unit 56 includes inlets 64 for receiving the air-borne stream of roughly graded material which has been conveyed via conduits 58 and 60. Each one of a pair of tumbler mechanisms in the form of cylindrical drums 66 within the distributor unit is adapted to receive a stream of the roughly graded material from the inlets 64. An air flow conductor 67 encompasses the distributor unit 56 and serves to direct ambient air across the unit through the carrier 62 under the influence of a suction box 69. The suction box is located beneath the carrier 62 and serves to draw first finely graded material which issues from the distributor unit down onto the surface of the carrier.

Figure 2:
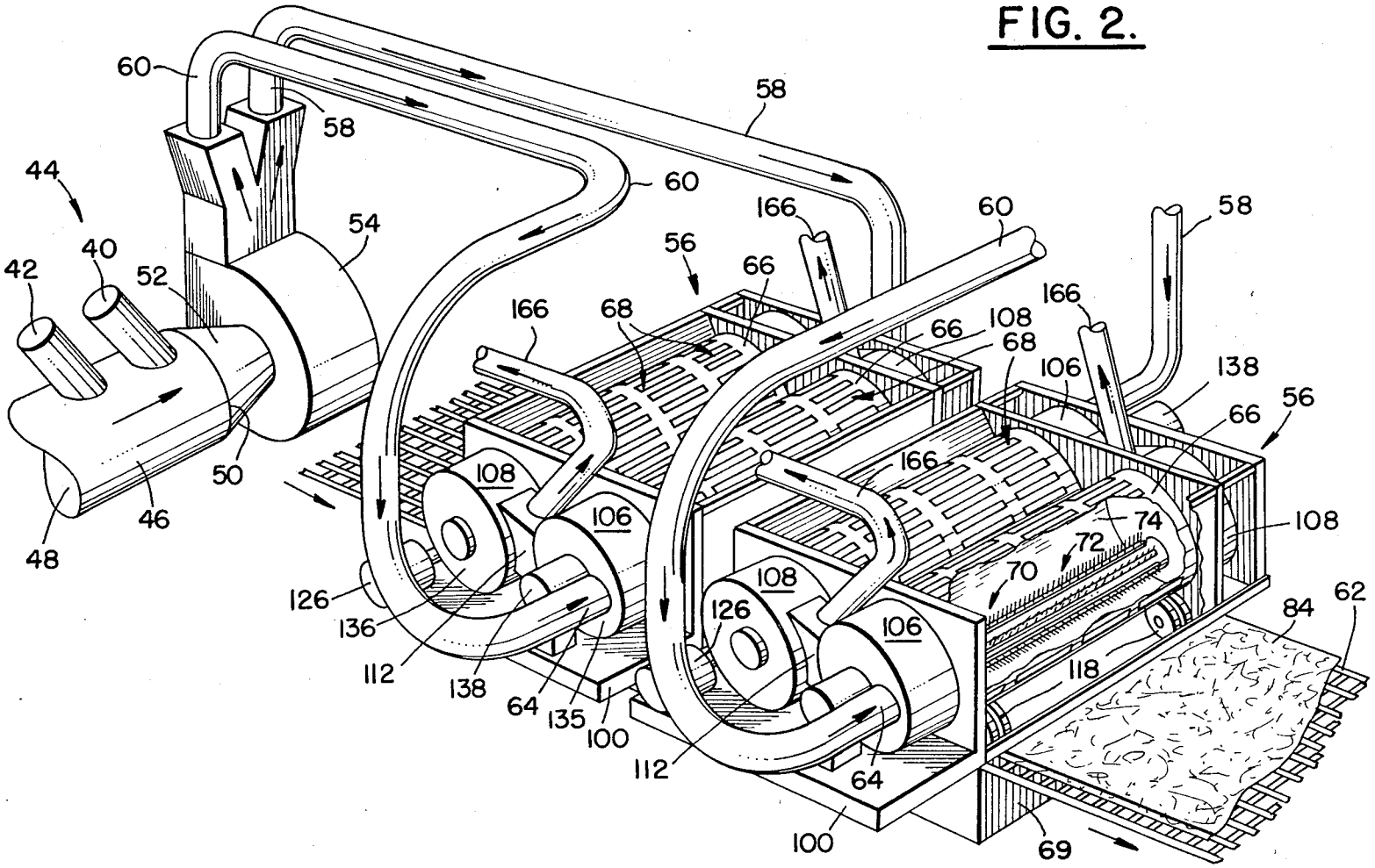
FIG. 2 is a perspective view, certain parts being cut away and in section, of parts of the system schematically illustrated in FIG. 1.

With particular reference to FIG. 2, each cylindrical drum 66 is rotatably mounted about its longitudinal axis and has a plurality of outlet or classification apertures 68 extending therethrough. Additionally, a rotatable brush roll 70 extends within each drum 66 and has a longitudinal axis generally parallel to that of the drum. Each brush roll is provided with a plurality of wire-like members 72 which extend radially outwardly from the brush roll and are adapted to rotationally agitate the roughly graded material within the drum. Such agitation is supplemental to that of the drum itself as will be described in more detail subsequently. The drum is caused to rotate and thereby imparts a tumbling action to the roughly graded material. That is, upon rotation the drum carries upwardly the roughly graded material which may have fallen onto the bottom of an interior surface 74. When it reaches the top of the drum, the roughly graded material tumbles downwardly once again, this process occurring over and over. The wire-like members 72 are mounted on the brush rolls 70 in a spiral pattern which imparts a limited amount of flow to the air-borne stream of roughly graded material downstream of the inlet 64. A primary function of the brush rolls, however, is for the wire-like members, in the course of their rotation, to strike individual fibers and/or particles within the air-borne stream of roughly graded material, flinging them outwardly through the classification apertures 68. Thus, the brush rolls 70 are responsible for causing flow of first finely graded material from the drums to a zone external thereof. Those fibers and/or particles which are not eventually discharged through the classification apertures are unsuitable for web formation and, as will be described subsequently, will be removed from the distributor unit 56.

The outlet apertures 68 are of a predetermined shape, number and size, as specifically related to the types of fibers and/or particles introduced to the system 30 from the feeding devices 32. For example, small, round apertures 76 (see FIG. 7) having a diameter of 3 mm. are generally desirable for discharging fibers and/or particles up to 5 mm. in length, although some allowance must be given for the thickness or diameter of a given fiber. A typical drum may have a diameter of 570 mm. with the number of apertures being 140,000 per meter of drum length. Of course, it will be appreciated that the capacity or mass flow rate of the system is a function of the surface area of a drum which is apertured. At the same time, apertures which are too large for a given type of fiber will have a detrimental effect on the homogeneity desired in the resultant web of material laid on the carrier 62. A goal of the system, then, is to achieve the maximum capacity while assuring the homogeneous composition of the end product.

In another instance, the apertures may be in the form of elongated slots 78 formed in the drum 66. As illustrated in FIG. 8, the slots 78 are rectangular and are located at regularly shaped intervals on the drum, both axially and circumferentially, and have an axial dimension substantially greater than a circumferential dimension. As a typical example, the slots 78 may be 2 mm. wide and 50 mm. long for discharging fibers and/or particles up to 25 mm. in length. A typical drum having a diameter, as before, of 570 mm., may have 7,000 apertures per meter of drum length. In FIG. 7, slots 79 which may be dimensioned similarly to slots 78 are illustrated as being in a staggered pattern on the drum 66. That is, while they are located at regularly spaced intervals around the circumference of the drum, they are staggered relative to one another in the axial direction. The slots 79 have also been found satisfactory for purposes of the invention while increasing the structural rigidity of the drum.

After the first finely graded material has passed through the classification apertures 68, the suction box 66 serves to redirect the resulting fibers and/or particles downwardly onto the carrier 62 such that the material is deposited in a homogeneous structure upon the surface of the moving carrier.

It is noteworthy that a primary feature of the air forming system being described is its ability to controllably produce and maintain homogeneity of a mixture of different fibers and/or particles throughout the entire process being described. Specifically, the homogeneity of the mixture of roughly graded material which is created in the blender 44 continues as the mixture travels through the distributor unit 56 and is operated upon by the rotating drums 66 and brush rolls 70. That same homogeneous condition is found in the final web which is deposited on the surface of the carrier 62. It is proper to stress this feature because it is necessary to determine the apertures needed in the drums so as to maintain the homogeneity of the predetermined mixture in order to obtain an end product which is suitable for a given purpose, whatever that purpose may be. The final web is referred to as second finely graded material because components of the first finely graded material discharged from the drums may be caused to pass through the carrier as other components are deposited on the carrier. Thus, the final web formed on the carrier is slightly different in its characteristics from the first finely graded material which issues from each drum.

Thus, even while homogeneity of the fibers and/or particles is maintained throughout the process, the composition of the air-borne material is changing as the process proceeds. That is, while an air-borne stream of the roughly graded material is continuously being circulated within the distributor unit 56, a first refinement of those roughly graded materials occurs as they are discharged from the drums. Those refined fibers and/or particles which are classified by the apertures 68 are referred to as first finely graded material. The latter, in turn, is further refined as the web is formed on the carrier 62, and the resulting web is properly referred to as being of second finely graded material.

As the web of the second finely graded material is formed on the upper surface of the carrier 62, a suitable conveyer 80 continues to advance the carrier 62 and the fiber structure thus formed for subsequent operations as generally indicated by a reference numeral 82. Such subsequent operations may entail, for example, bonding of the fiber structure with heat and/or pressure. Other bonding methods may include the application of a bonding agent by spraying, foaming or saturation. Another typical subsequent operation may include laminating a web formed by the apparatus with a separate film, scrim, or nonwoven material into a single multiple layer structure. A large variety of other operations compatible with the disclosed apparatus are also possible but are too numerous to mention.

It will be appreciated that in a preferred embodiment of the invention a variable speed motor 83 is employed to drive the conveyor 80. In this manner, the thickness of the web can be controlled, a thinner web resulting when the conveyor is operated at a high speed and a thicker web resulting when the conveyor is operated at a low speed.

It has previously been mentioned that a primary feature of the invention resides in its ability to form a predetermined homogeneous web of material. Such a web can be produced from blends of at least two different types of fibers. It has also been mentioned as desirable to utilize long thermoplastic fibers with wood pulp fibers and then to activate the thermoplastic fibers by applying heat and/or pressure for bonding the structure together. Such a bonding process would be expected to take place downstream of the distributor unit 56, and specifically in the region referred to as subsequent operations and indicated by the reference numeral 82. Typical lengths of wood fibers are in the range of 2–3 mm. and typical lengths of thermoplastic fibers, polypropylene being one example, are in the range of 15–25 mm. Such an ability to form a homogeneous air laid fiber structure incorporating fibers of the lengths mentioned is yet another primary feature of the invention.

Alternatively, if an air-laid web or structure of the nature just described is compacted in certain suitably spaced areas only, then a high level of bonding can be achieved while simultaneously maintaining the bulk, absorption, and other desirable properties of the product. To this end, viewing FIG. 6, an unconsolidated dry formed web 84 composed of wood pulp fibers 86 and of elongated thermoplastic fibers 88 is introduced between two heated embossing rollers (not shown) which are pressed and held together for a sufficient length of time to fuse the synthetic or bonding fibers and the wood pulp fibers together. For purposes of explanation, it may be that an upper embossing roll has elevated rills which engage the web 84 at a number of parallel, spaced apart areas 90 and that a lower embossing roll has elevated rills which engage the web at a number of parallel, spaced apart areas 92 which are transverse to those formed by the upper roll.

The strongest bonds are achieved in those areas 94 at which the rills on the two surfaces cross. A typical compaction pressure at such locations might be 250 $kg/cm^2$. A certain amount of compaction also occurs in those areas at which the web is displaced by the rill in one embossing roll into an indented area in the opposing roll. This displacement aids in bonding and also contributes to the bulk of the final product. The lowest compaction is achieved in those areas of the web corresponding to indented areas in both embossing surfaces. These areas are the most bulky and most absorbent parts of the product. The actual thickness of the final product largely depends upon the depth of the indentations in the embossing rolls. Of course, the level of bonding at these areas is generally low. Such bonding can occur by either pressure or heat or any combination thereof.

It will be appreciated that if the product as a whole is to be coherent and strong, it is important that the rills be relatively close together so that a sufficiently high proportion of the thermoplastic fibers 88 bridge the distance between the bonding areas, thereby locking them firmly at two or more locations along their length. These fibers will then act as direct loadbearing elements in the web structure, and will also encase those fibers which have only one or no strongly bonded locations along their length. At the same time, however, the closer together the rills, the lower the bulk of the product and the less absorbent it is.

Figure 6:
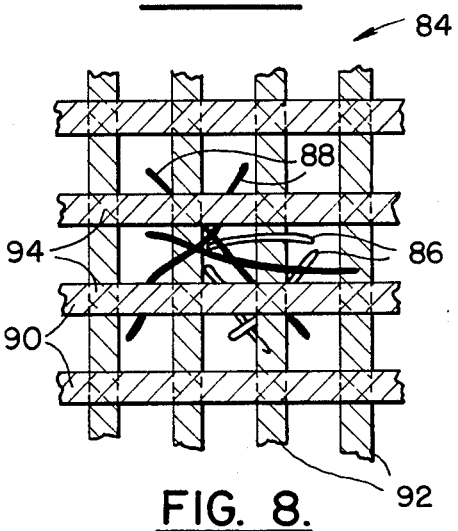
FIG. 6 is a detail top plan view illustrating in a magnified representation, a product resulting from operation of the air forming system of the invention.

In FIG. 6, the relative dimensions of the two constituent fibers are shown in relation to the spacing and width of the rills. It is noteworthy, in particular, that while only a very small proportion of the wood pulp fibers 86 are locked in at two of the areas 90 and 92 along their length, a relatively high proportion of the thermoplastic bonding fibers 88 bridge two or more of those areas. Thus, the bonding fibers are almost entirely responsible for the strength and coherency of the product whereas the wood pulp fibers act more as a filler, giving bulk, absorption, opacity and softness to the product.

The distributor unit 56 will now be described in greater detail. As seen in FIGS. 2–5, the distributor unit 56 includes a pair of receptacles 96 and 98 suitably mounted on a frame 100 for temporarily containing the air supported fibers. Each of the receptacles 96 is of a circular cross section and encloses a space which can arbitrarily be said to have an upper region 102 and a lower region 104. Each of the receptacles 96 and 98 is composed of a pair of spaced apart cup shaped stationary end members 106 and 108 and one of the cylindrical drums 66 as previously described. The end members 106 and 108 are suitably fixed to the frame 100, are generally similar, but mirror images of one another, and are axially aligned. Each of the end members defines a cavity 110 which faces towards the cavity of the other end member. The inlet 64 is suitably mounted to each of the end members 106 and communicates with the cavity 110 so as to permit a stream of air supported fibers to flow from the fiber feeding devices 32 and 34 into the receptacles 96 and 98. It is to be noted that the end members 106 of the receptacles 96 and 98 are diagonally opposed to one another and can be described as being upstream end members by reason of the fact that flow of the air supported fibers is initiated within their respective cavities.

Just as each of the receptacles 96 and 98 have an upstream end member 106, each receptacles also has a downstream end member 108 toward which the air supported stream of fibers is directed after entering via the inlets 64. A pair of chute members 112 extends, respectively, between the end member 108 of the receptacle 96 and the end member 106 of the receptacle 98, and vice versa. In each instance, the chute member 112 connects the upper regions 102 of an end member 108 with the lower regions 104 of an end member 106. By reason of the chute members 112, continuous circuitous flow of the stream of air supported fibers is assured through the entire distributor unit 56, beginning at the inlet 64 and continuing through the receptables 96 and 98.

Figure 3:
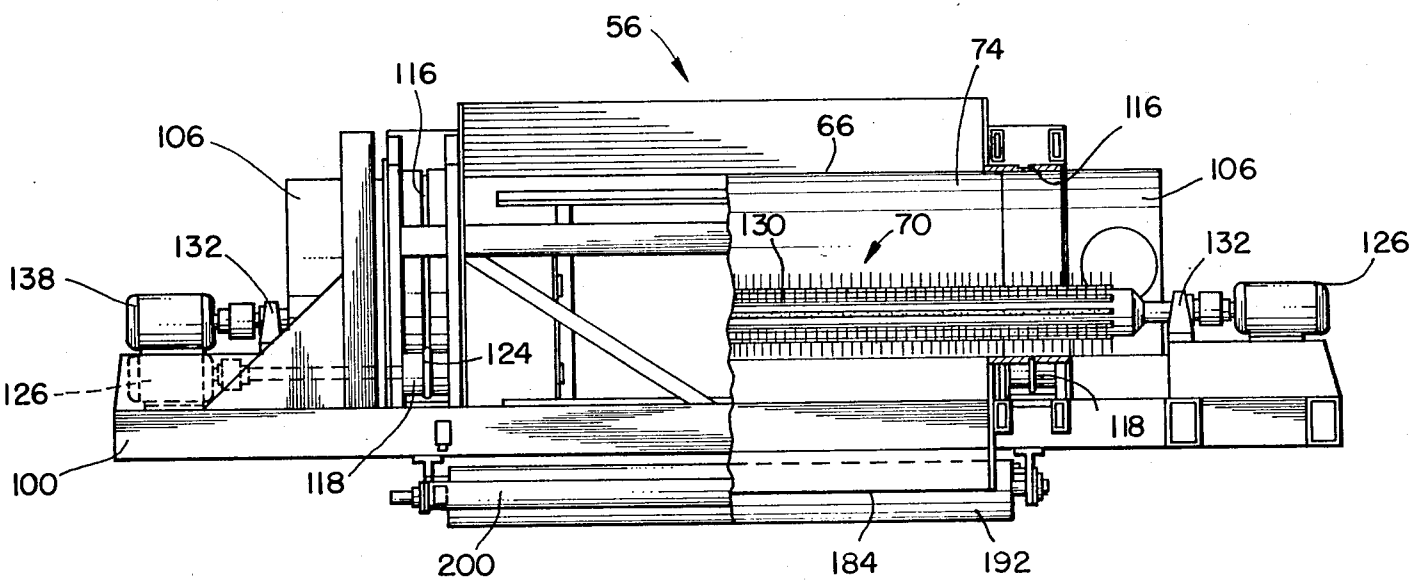
FIG. 3 is a front elevation view of a distributor unit which is a part of the invention, certain parts being cut away and in section.
Figure 4:
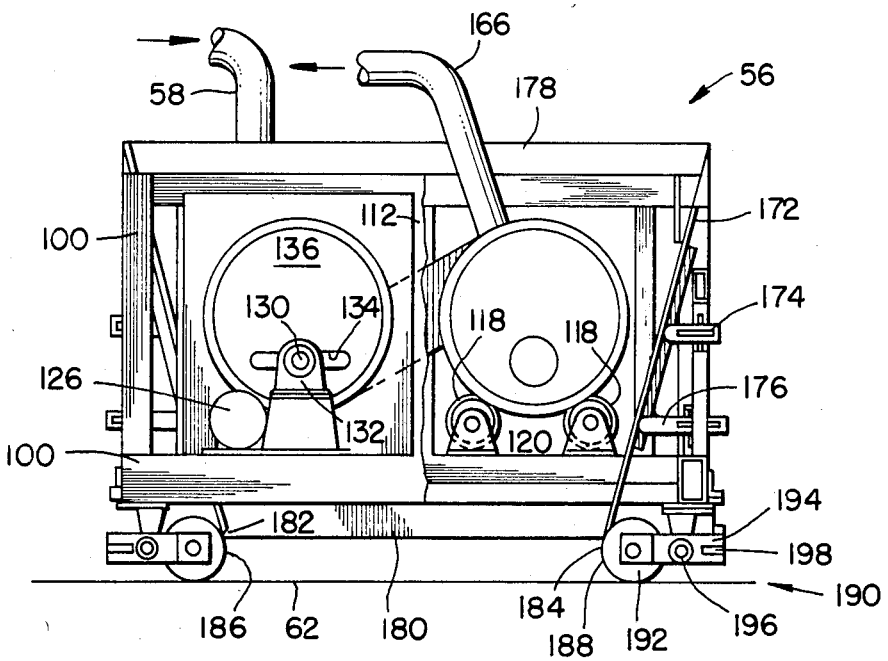
FIG. 4 is a side elevation view of the distributor unit illustrated in FIG. 3.
Figure 5A:
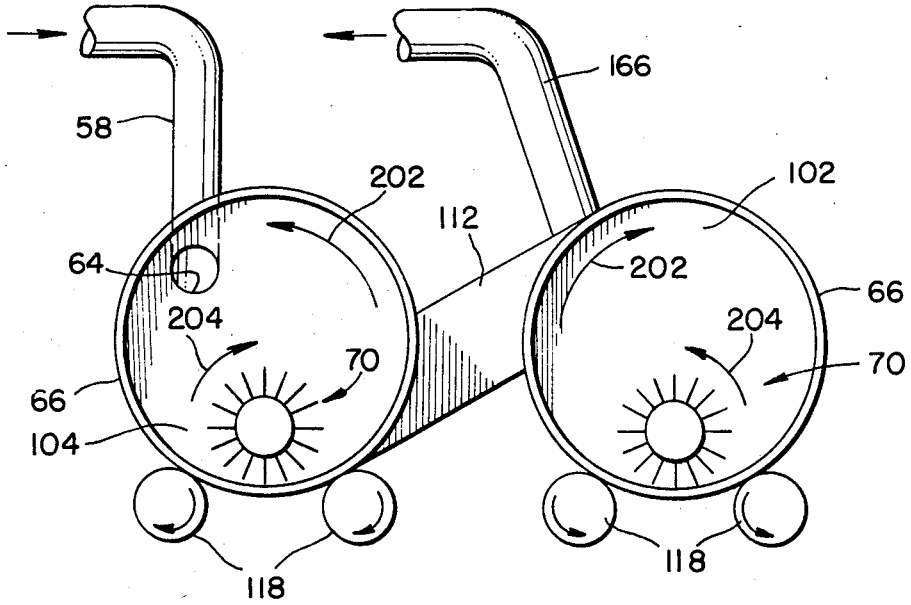
FIG. 5A is a cross section view taken generally along line 5A—5A in FIG. 5.
Figure 5:
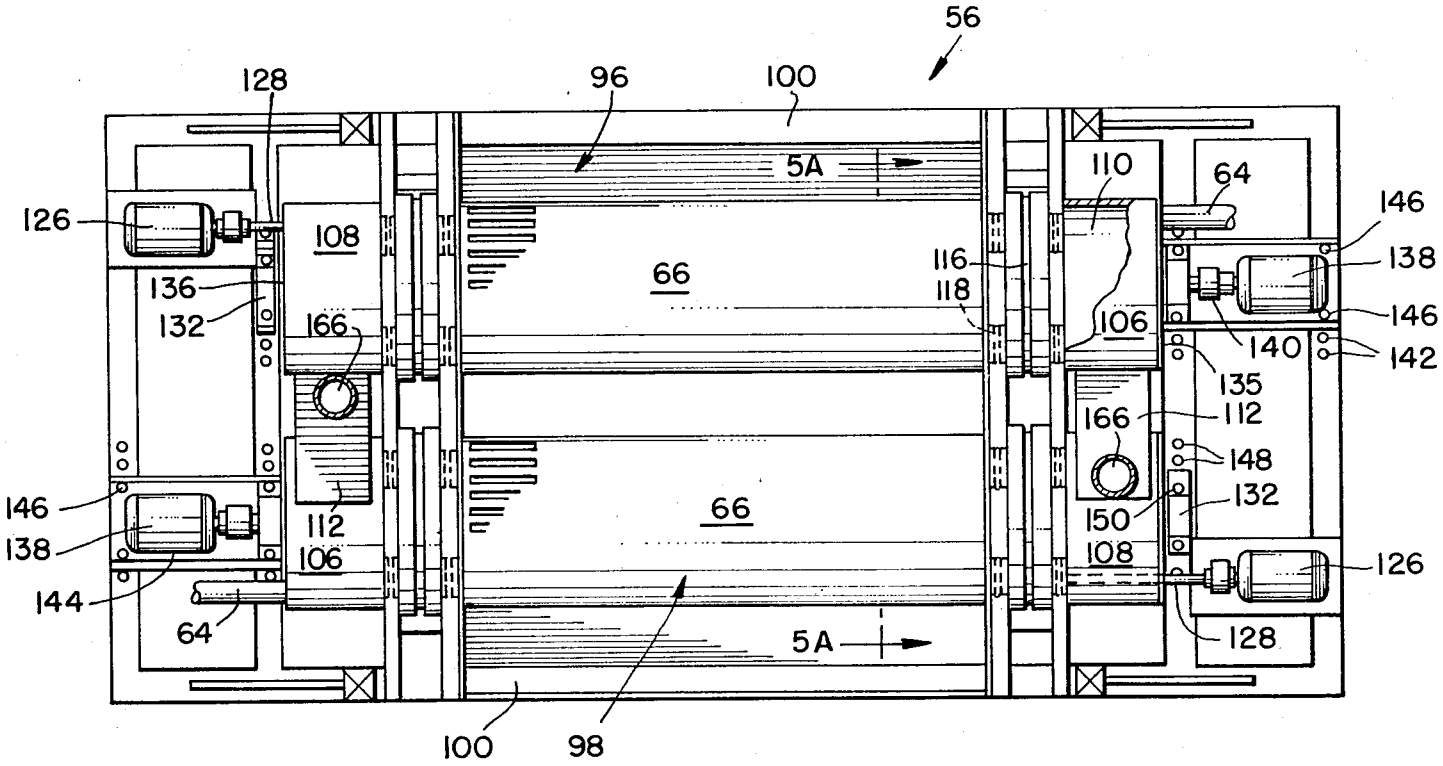
FIG. 5 is a top plan view of the distributor unit illustrated in FIGS. 3 and 4.

As seen especially well in FIGS. 3–5, the drums 66 are rotatably mounted between the end members 106 and 108, are coaxial therewith, and generally have the same diameter as the end members. Each drum 66 includes a pair of end rings 114 which are suitably fixed to the drum at its ends in any suitable fashion, as by welding or by way of a force fit. A circumferential groove 116 is formed in each of the end rings 114. Each drum is rotatably mounted on four roller bearings 118. The four roller bearings are all rotatable about spindles whose axes lie in a substantially horizontal place, the spindles, in turn, being mounted on support ears 122 which are fixed on the frame 100. Each roller bearing 118 is formed with a centrally positioned annular ring 124 which is matingly engagable with the circumferential groove 116. Thus, two roller bearings 118 are in rolling engagement with the outer surface of each end ring 114. A motor 126, fixed to the frame 100, drives one of the roller bearings 118 by means of a shaft 128, the remaining three roller bearings used in conjunction with a drum 66 being idlers.

The motor 126 is preferably of a variable speed design so as to enable regulation of the rotational speed of the drum 66. As previously noted, drum speed has an effect on the capacity of the system as well as on the quality of the end product.

Each brush roll 70 includes a shaft 130 which extends through its associated drum 66 along an axis which is generally parallel with the longitudinal axis of the drum. The shaft 130 is supported at both ends by a pillow block 132 suitably attached to the frame 100 and extends through suitably shaped apertures 134 (FIG. 4) formed in end plates 135 and 136 of the end members 106 and 108, respectively. A suitable motor 138, preferably of the variable speed type, is connected to the shaft 130 by a coupling 140. Control of the rotational speed of the brush roll 70 is an important feature of the invention for the same reason mentioned previously with respect to control of the rotational speed of the drum 66. Specifically, the rotational speed of the brush roll has a direct effect on the capacity of the system as well as on the quality of the end product. In general terms, it can be said that the greater the speed of the brush roll, the greater the capacity of the system.

However, the position of the axis of the shaft 130 also has an effect on the capacity of the system and on the quality of the end product. Thus, it has been found desirable to be able to adjust the position of the tips of the wire-like members 72 relative to the interior surface 74 of the drum. To this end, holes 142 are suitably provided in the frame 100 to match with similarly located holes (not shown) provided in platform 144 for the motor 138 and its associated pillow block 132. Suitable fasteners such as bolts 146 are receivable through the mating holes to releasably fasten the platform 144 to the frame 100. Similarly, holes 148 are provided at the opposite end of the frame 100 to receive suitable fasteners, such as bolts 150, which serve to mount the pillow block 132 to the frame. The arrangement of the holes 142 and 148 is such that the brush roll 70, its shaft 130, motor 138, and pillow blocks 132 can all be moved laterally to a variety of different positions while assuring that the axis of the shaft 132 remains parallel to the axis of the drum 66. Thus, the fasteners 146 and 150 can be removed to allow the brush roll 70 to be repositioned, then replaced and tightened to hold the brush roll in its new position.

In practice, it has been found that a desirable range of distances of the tips of the wire-like members from the interior surface of the drum 74 lies in the range of 5 to 25 mm. When the system is handling the longest fibers normally operated upon by the air forming system 30, it is preferable to place the brush roll at its closest position relative to the interior surface 74 of the drum. With shorter fibers and particles, it is preferable for the brush roll to be at a more distance location.

With particular reference now to FIGS. 10–14, each brush roll 70 is provided with a plurality of elongated mounting blocks 152 mounted by the use of fasteners 154 to the outer surface of the shaft 142 at equally spaced circumferential locations (see FIG. 11). Each mounting block 152 extends a substantial distance along the length of the brush roll generally parallel with the longitudinal axis of the brush roll. Also, each mounting block 152 has a generally flat outer surface 156 (see FIGS. 13 and 14), a longitudinal recess 158 on an opposite side thereof and extending the length of the block, and a plurality of holes 160 which extend through the block between the flat surface 156 and the recess 158. As seen particularly well in FIG. 12, the holes are staggered and adjacent pairs of the holes fittingly receive legs 152 of the wire-like members. As illustrated in FIG. 14, the wire-like members 72 are bent into a u-shape so as to define a pair of generally parallel spaced apart legs 162 connected by a bight portion 164 generally midway between the ends of the members 72. When the wire-like members 72 are fully mounted on the blocks 152, the bight portion 164 engages the innermost surface of the recess 158 and the legs 162 extend in a direction away from the outer surface 156. As the shaft 132 rotates, the wire-like members 72 aid in directing flow of the air-borne fibers and/or particles within the receptacles 96 and 98 between the end members 106 and 108.

Not all of the fibers and/or particles which are introduced into the system and supported in an air-borne stream flow through the apertures 68 after they are introduced into the receptacles 96 and 98 via the inlets 64. In some instances, fibers and/or particles may be undesirably clumped together, or they may not be of the proper size in keeping with the apertures 68 for a particular operation, or for some other reason they may not be of the quality necessary to achieve a desired end product. It has therefore been found to be desirable to provide each receptacle 96 and 98 with a withdrawal mechanism for removing such unsuitable fibers.

As the brush roll 70 is rotated, it engages that material which enters the end member 108 and flings it upwardly. Lighter elements of the material, such as nits, are driven to the upper region 102 (see FIG. 5A) of the end member. As seen most clearly in FIG. 5A, a withdrawal conduit 166 is attached at one end to a downstream end member 108 in the location at which the chute member 112 interfaces with the end member 108. The conduit 166 communicates with the cavity 110 in the end member and extends to, and is in communication with, the feeding device 32. Of course, the conduit 166 can also be extended for communication with the feeding device 34 should that be desired. A suitable flow generator 168 is operatively associated with the withdrawal conduit 166 for thereby withdrawing the lighter elements of the air-borne stream from the cavity 110 and returning them to the feeding device 32. Heavier elements of the material, such as fiber clumps, are driven into the chute 112 where they are then engaged by the brush roll 70 of the associated receptacle and flung into the virgin stream of roughly graded material entering via the inlet 64. In this manner, the heavier elements begin yet another circuit through the receptacle.

It was previously explained that the downward air flow external of the receptacles 96 and 98 and causing the air supportive fibers to be deposited onto the carrier 62 is generated by means of the suction box 69, the flow being generally directed by the air flow conductor 67. With particular reference to FIGS. 3–5, the air flow conductor 67 is seen to include generally vertical side walls 170 and generally slanted end walls 172. The side walls 170 are fixed to the frame 100, while the end walls 172 are adjustably mounted to the frame 100 by means of brackets 174 and 176.

As most clearly seen in FIG. 4, by reason of the end walls 172, the air flow conductor 67 extends between an open enlarged end 178 and an open reduced end 180 which is positioned adjacent the carrier 62. The reduced end 180 extends across the carrier 62 as defined by lower edges 182 and 184 of the end walls 172. The edge 182 defines an entrance opening for the carrier 62 as it moves into proximity with the distributor unit 56. Similarly, the lower edge 184 defines an exit opening between its associated end wall 172 and the carrier 62 as the carrier 62 is about to move out of proximity with the distributor unit 56.

A pair of substantially similar sealing mechanisms 190 are positioned adjacent the lower edges 182 and 184 and serve to seal the openings 186 and 188 to assure that the air flow continues to be confined within the conductor 67 throughout operation of the system. With particular reference now to FIGS. 3 and 4, each sealing mechanism 190 is seen to include seal roll 192 which is rotatably mounted at its ends on spaced apart arms 194 which, in turn, are pivotally mounted as at 196 to the frame 100. Each seal roll 192 is coextensive with the lower edges 182 and 184 and with the openings 186 and 188. It rollingly engages the upper surface of the carrier 62, or of the web formed thereon. The ends of the arms 194 distant from the seal roll 192 are formed with slots 198 which serve to adjustably receive the ends of a counter balance bar 200. That is, the bar 200 can be suitably positioned relative to the pivot 196 so as to vary the bearing pressure of the seal roll 192 onto the carrier 62. When the bar 200 is closest to the pivot 196, the pressure applied by the seal roll 192 onto the carrier 62 is greatest, and vice versa. By reason of the adjustable brackets 174 and 176, the end walls 172 can be moved so that the lower edges 182 and 184 are positioned in a proximate relationship with the seal rolls 192 to assure that there will be minimum leakage of air from the system.

The operation of the system 30 will now be described. At the outset, the composition of the web to be formed must be determined and appropriate adjustments must be made to the system in order to accommodate formation of the particular end product chosen. Specifically, a drum 66 with the appropriate apertures 68 must be selected and mounted in position. If only short fibers and/or particles are being processed, that is, fibers having lengths less than 5 mm., then a drum 66 having round apertures having a diameter of 3 mm. would be proper. However, if individual fibers having lengths in the range of 15–25 mm., or mixtures of fibers in which at least one of the fiber types is of a length in the range of 15–25 mm., then the appropriate apertures would be rectangular, those indicated by the reference numerals 78 or 79 in FIGS. 8 and 9, respectively, and approximately 50 mm. long by 2 mm. wide.

Additionally, the position of the brush roll 70 in relation to its associated drum 66 is important. It has been found preferable that the diameter of the brush roll be approximately one-half that of the drum, so there is adequate room within the drum to maneuver the brush roll in the manner previously described. In this regard, it has been explained that the distance of the tips of the wire-like members 72 from the interior surface 74 of a drum is also chosen according to the types of fibers being processed. Generally, the longer the fibers, and the greater the mass flow rate sought, the closer the tips would desirably be to the surface 74. Hence, if either long fibers, that is, fibers having lengths in the range of 15–25 mm. are to be utilized for the process, or mixtures of such long fibers together with shorter fibers and/or particles, then an appropriate distance would be 5 mm. For the shortest fibers and/or particles or for mixtures of only short fibers and/or particles, then, the distance could range up to approximately 25 mm. Accordingly, the brush rolls 70 and their associated drive components must be laterally positioned on the frame 100, then secured, to achieve the appropriate spacing between the tips of the wire-like members 72 and the interior surface 74 according to the types of fibers being processed.

For optimum results, the drums 66 and their associated brush rolls 70 are rotated in opposite directions as indicated by arrows 202 and 204 (see FIG. 5A). A typical rotational speed for the drum is 160–170 rpm and for the brush roll is 1400 rpm, although these speeds can be varied as noted above.

The appropriate fibers which have been chosen to be processed, therefore, are conveyed from the feeding devices 32 and 34 to the blender 44 where they are thoroughly and homogeneously mixed together and then further conveyed, via conduits 58 and 60, into the receptacles 96 and 98. The mass flow rate of the air-borne stream of the fibers and/or particles may be on the order of 3600 $m^3$/hr. This mass flow rate occurs continuously from the feeding devices 32 and 34 to and through the receptacles 96 and 98. However, by reason of the volume of the receptacles 96 and 98, the flow rate diminishes substantially once the air supported fibers reach the cavities 110 in the end members 106. At this point, the air supported fibers come under the control of the rotating drum 66 and of the rotating brush rolls 70. Within the receptacles 96 and 98, the fibers are continuously being agitated by both the rotating drums and by the rotating brush rolls as they advance along their circuitous route.

Additionally, rotation of the brush roll causes the members 72 to strike individual fibers and/or particles, flinging them outwardly, toward the interior surface 74 and through the apertures 68. Yet another function of the brush roll 70 is to cause elements of the air-borne stream of roughly graded material which passes into the cavity of an end member 108 either to advance through the chutes 112 at the ends of the receptacles 96 and 98 or to be drawn off through the withdrawal conduits 166 and returned to the feeding devices for further processing before being readmitted into the system.

However, it will be appreciated that the vast majority of the fibers and/or particles first entering the receptacles through the inlets 64 will advance through the apertures 68 on their first pass through the system. Once outside of the receptacles 96 and 98, the first finely graded material, still maintaining a homogeneous form, is then drawn onto the carrier 62, creating a web of the second finely graded material.

After passing beneath the sealing mechanism 190, the newly formed web can then be subjected to the subsequent operations as generally indicated at 82.

The disclosure has noted that the system of the invention is not merely applicable to fibers and to blends of fibers but to particles as well. For purposes of the invention, the term "particles" is intended to encompass any other desirable components for forming a web including, but not necessarily limited to, powders, pellets, flakes, or the like. For example, it has been found desirable, in certain instances, to incorporate into an end product powders or particles or other additives for a variety of purposes. These additives may be for such uses as to provide filler material for increasing the bulk of the end product, or to provide binder material for aid in a subsequent binding operation, or may be super absorbent material which is useful when end products are, for example, diapers, feminine napkins, underpads, liquid filters, and the like. In any event, such additives may enter the system by way of the feeding devices 32 and 34 and then be suitably blended with one or more fibers in the blender 44. As an alternative, they can be added directly to the receptacles 96 and 98 by way of the inlets 64 or some other suitably placed device. In the latter instance, the additives would be effectively mixed with the fibers by means of the rotating drums and brush rolls. Regardless of the manner of entry of the additives into the system, the distributor unit 56 is effective in assuring that the end product formed on the carrier 62 is a homogeneous mixture of the fibers and additives.

The structure and operation of the air forming system 30 generally embodying the principles of the present invention now having been described, it is considered that the benefits and distinguishing features of the invention can be even better understood with the aid of examples. The following examples reflect the processing of a variety of different fiber types utilizing the disclosed system. It is noteworthy that the variable machine characteristics are restricted to the number, shape, and size of the apertures 68 in the wall of the drum 66, to the distance of the tips of the wire-like members and to the temperature of the heater used for bonding of the fiber structure in a subsequent operation, as indicated at 82.

EXAMPLE 1

Fiber Components

| TYPE | PERCENTAGE | MAXIMUM LENGTH, mm | DIAMETER MICRONS |
|---|---|---|---|
| Polypropylene | 15% | 2.5 | 10–20 |
| Wood pulp | 85% | 2.5 | 30–50 |

Machine Characteristics

Carrier, surface speed = 50–100 m/min.
Brush roll
- rotational speed = 1400 rpm
- wire diameter = 285 mm
- distance, wire tip to drum wall (closest) = 25 mm Drum
- diameter = 570 mm
- number of apertures = 140,000/meter of drum length
- shape of apertures = round
- size of apertures = 3 mm, dia.
- rotational speed = 167.5 rpm
- air flow rate in = 3,600 $m^3$/hr.
- air flow rate out = 3,600 $m^3$/hr.

mass flow rate of fibers = 250 kg/hr./meter of drum length
Downward air flow
velocity = 150–180 m/min.
flow rate (per pair of drums) 300–360 $m^3$/hr.
Heater for bonding product
temperature = 170° C.

Product Characteristics

Measured thickness = 1.2 mm
Basis weight = 140 g/$m^2$
Suitable as an absorbent pad, such as a feminine hygiene pad which is soft, moderately strong, and cloth-like.

EXAMPLE 2

Fiber Components

| TYPE | PERCENTAGE | MAXIMUM LENGTH, mm | |
|---|---|---|---|
| Wood pulp | 80% | 2.5 | 30–50 microns dia. |
| P & E* | 20% | 5.0 | 3.0 denier |

*Bi-component staple (thermal bonding) fiber

Machine Characteristics

Carrier, surface speed = 50–100 m/min.
Brush roll
rotational speed = 1400 rpm
wire diameter = 285 mm
distance, wire tip to drum wall (closest) = 15 mm
Drum
diameter = 570 mm
number of apertures = 55,000/meter of drum length
shape of apertures = round
size of apertures = 4 mm, dia.
rotational speed = 167.5 rpm
air flow rate in = 3,600 $m^3$/hr.
air flow rate out = 3,600 $m^3$/hr.
mass flow rate of fibers = 250 kg/hr./meter of drum length
Downward air flow
velocity = 150–180 m/min.
flow rate (per pair of drums) = 300–360 $m^3$/hr.
Heater for bonding product
temperature = 130° C.

Product Characteristics

Measured thickness = 0.7 mm
Basis weight = 90 g/$m^2$
Suitable as a disposable wiper which is stronger than the product of Example 1, cloth-like, absorbent, and abrasion-resistant.

EXAMPLE 3

Fiber Components

| TYPE | PERCENTAGE | MAXIMUM LENGTH, mm | |
|---|---|---|---|
| Wood pulp | 75% | 2.5 | 30–50 microns dia. |
| Polypropylene | 25% | 10.0 | 3.0 denier |

Machine Characteristics

Carrier, surface speed = 50–100 m/min.
Brush roll
rotational speed = 1400 rpm
wire diameter = 285 mm
distance, wire tip to drum wall (closest) = 10 mm
Drum
diameter = 570 mm
number of apertures = 24,000/meter of drum length
shape of apertures = rectangle
size of apertures = 1.5 × 20 mm, dia.
rotational speed = 167.5 rpm
air flow rate in = 3,600 $m^3$/hr.
air flow rate out = 3,600 $m^3$/hr.
mass flow rate of fibers = 250 kg/hr./meter of drum length
Downward air flow
velocity = 150–180 m/min.
flow rate (per pair of drums) = 300–360 $m^3$/hr.
Heater for bonding product
temperature = 160° C.

Product Characteristics

Measured thickness = 0.6 mm
Basis weight = 68 g/$m^2$
Suitable as a disposable table cloth which is stronger than the product of Example 1 but less absorbent, more abrasion-resistant, and printable.

EXAMPLE 4

Fiber Components

| TYPE | PERCENTAGE | MAXIMUM LENGTH, mm | DIAMETER MICRONS |
|---|---|---|---|
| Fiber glass | 100% | 25 | 2 |

Machine Characteristics

Carrier, surface speed = 50–100 m/min.
Brush roll
rotational speed = 1400 rpm
wire diameter = 285 mm
distance, wire tip to drum wall (closest) = 5 mm
Drum
diameter = 570 mm
number of apertures = 7,000/meter of drum length
shape of apertures = rectangular
size of apertures = 2.0 mm × 50.0 mm
rotational speed = 167.5 rpm
air flow rate in = 3,600 $m^3$/hr.
air flow rate out = 3,600 $m^3$/hr.
mass flow rate of fibers = 250 kg/hr./meter of drum length
Downward air flow
velocity = 150–180 m/min.
flow rate (per pair of drums) = 300–360 $m^3$/hr.

Product Characteristics

Measured thickness = 1.25 mm
Basis weight = 66 g/$m^2$
Suitable as an air filter medium which has good filtration and is fire proof.

While a preferred embodiment of the invention has been disclosed in detail, it should be understood by those skilled in the art that various modifications may be made to the illustrative embodiment without departing from the spirit and the scope thereof as described in the specification and defined in the appended claims.

What is claimed is:

1. A process for forming an air laid web of predetermined characteristics comprising the steps of:

(1) forming a stream of roughly graded material of first loose fibers and at least one of
(a) second loose fibers
(b) particles, (2) directly and controllably introducing said stream of material into a mixing zone with air to produce an air-borne stream of said roughly graded material;

(3) forming a recirculating air-borne stream of said roughly graded material and said stream includes some clumps of fibers, called nits;

(4) causing said nits to be removed from said recirculating stream at at least two spaced locations;

(5) introducing said air-borne stream of step (2) into said recirculating stream of step (3);

(6) causing at least a portion of said recirculating stream of roughly graded material to rotate in one direction;

(7) causing an internal portion of said recirculating stream to rotate in an opposite direction to that of step (6);

(8) removing from the perimeter of said recirculating stream roughly graded material at the general location of said contrarotation, material of a predetermined size and shape to be a first finely graded material;

((9) causing said first finely graded material to become a directionalized air-borne stream;

(10) providing a translating zone of a portion of said first finely graded material where said translation is in a direction transverse to said directionalized air-borne stream of step (9); and

(10) providing a second fine grading of said material in said air-borne stream by arresting predetermined sizes and shapes of said first finely graded material in said translating zone to provide said web of predetermined characteristics as a second finely graded material web.

2. A process as set forth in claim 1 comprising the additional step of:

(11) controlling the rate of translation of said translating zone to thereby control the thickness of said web.

3. A process as set forth in claim 1 in which said rough graded loose fibers comprise at least first and second fibers and nits thereby comprising the additional step of:

(12) controlling the ratio of said first loose fibers and said second loose fibers and said particles in said stream of roughly graded material being introduced into said mixing zone in step (2).

4. A process as set forth in claim 1 comprising the additional step of:

(13) controlling the rate of flow of said air-borne stream of step (2) introduced into said recirculating stream of step (3).

5. A process as set forth in claim 1 comprising the additional step of:

(14) controlling the speed of rotation of said portion of said recirculating stream as called for in step (6).

6. A process as set forth in claim 1 comprising the additional step of:

(15) controlling the speed of contrarotation of said internal portion of said recirculating stream as called for in step (6).

7. A process as set forth in claim 1 comprising the additional step of:

(16) controlling the rate of deposition of said second finely graded material web.

8. A process as set forth in claim 1 comprising the additional step of:

(17) adjustably positioning the contrarotation of said internal portion of said recirculating stream as called for in step (7) relative to the rotation of said portion of said recirculating stream as called for in step (6).

9. A process as set forth in claim 1 wherein the particles are composed of a filler material.

10. A process as set forth in claim 1 wherein the particles are composed of a binder material.

11. A process as set forth in claim 1 wherein the particles are composed of a superabsorbent material.

12. Apparatus for forming an air laid web of predetermined characteristics material comprising:

supply means forming a stream of roughly graded material of first loose fibers and at least one of
(a) second loose fibers
(b) particles
and for mixing the roughly graded material with air to produce an air-borne stream thereof;

distributor means forming a recirculating air-borne stream of the roughly graded material adapted to receive the air-borne stream from said supply means, said distributor means including tumbler means causing at least a portion of the recirculating stream of roughly graded material to rotate in one direction and agitating means causing an internal portion of the recirculating stream to rotate in an opposite direction to that of said tumber means, said recirculating stream to have clumps of fibers, called nits;

said tumbler means being a first fine grading means having a plurality of classification apertures extending therethrough being of a predetermined shape, number, and size as specifically related to the types of the roughly graded material desired in said webs of predetermined characteristic introduced to said distributor means;

said agitating means adapted to cause flow through the classification apertures of a first finely graded material;

a plurality of nit removal conduits communicating with said distributor means at spaced locations with reference to said recirculating air-borne stream to remove nits from said stream;

air flow producing means causing the first finely graded material to become a directionalized air-borne stream; and a foraminous carrier movable in a direction transverse to the directionalized air-borne stream being arranged to be a second fine grade means for arresting predetermined sizes and shapes of the first finely graded material resulting in a translating arrested web of material of predetermined characteristics.

13. Apparatus as set forth in claim 12 including variable speed drive means for moving said carrier at any one of a range of preselected speeds to thereby control the thickness of the web.

14. Apparatus as set forth in claim 12 wherein said supply means includes separate means of supply of at least first and second loose fibers, said supply means also includes valve means selectively operable to control the ratio of the first loose fibers and the second loose fibers and the particles being received in the air-borne stream.

15. Apparatus as set forth in claim 12 including means for controlling the rate of flow of the air-borne stream received within said distributor means.

16. Apparatus as set forth in claim 12 wherein said distributor means is positioned above the carrier and includes an air-borne stream receiving inlet connected to said supply means, and wherein said tumbler means includes a cylindrical drum adapted to receive the air-borne stream from said inlet, said drum being rotatable about its longitudinal axis, and wherein said agitating means includes a rotatable brush roll extending within said drum and having an axis generally parallel to the axis of said drum, a plurality of wire-like members extending radially outwardly from said brush roll adapted to rotationally agitate within said drum the roughly graded material in the air-borne stream and arranged to direct flow of the first finely graded material outwardly through the classification apertures.

17. Apparatus as set forth in claim 16 including first variable speed driver means for regulating the rotational speed of said drum to control the mass flow rate of the first finely graded material passing through the classification apertures.

18. Apparatus as set forth in claim 16 including second variable speed driver means for regulating the rotational speed of said brush roll to control the mass flow rate of the first finely graded material passing through the classification apertures.

19. Apparatus as set forth in claim 16 including first variable speed driver means for regulating the speed of rotation of said drum and second variable speed driver means for regulating the speed of rotation of said brush roll, to control the mass flow rate of fibers passing through the outlet apertures.

20. Apparatus as set forth in claim 19 wherein said drum and said brush roll rotate in opposite directions.

21. Apparatus as set forth in claim 16 wherein said drum has an interior surface, and wherein said distributor means includes support means rotatably mounting said brush roll and adjustment means for selectively adjusting the position of said shaft relative to said interior surface, and including second variable speed driver means for regulating the rotational speed of said brush roll to control the mass flow rate of the first finely graded material passing through the classification apertures.

22. Apparatus as set forth in claim 14 including means for controlling the rate of deposition of the second finely graded material web.

23. Apparatus as set forth in claim 14 wherein said air flow producing means includes suction means positioned adjacent said carrier for drawing air toward and through said carrier to aid in the deposition of the second finely graded material web on said carrier, and an air flow conductor surrounding said distributor means for directing ambient air drawn by said suction means across said distributor means and through said carrier, said conductor extending between an open enlarged end and an open reduced end spaced therefrom, said reduced end positioned adjacent said carrier.

24. Apparatus as set forth in claim 12 wherein said reduced end extends across said carrier adjacent thereto and has an edge extending transverse to the carrier at a downstream zone at which said carrier moves beyond said reduced end, said edge being generally parallel to the surface of said carrier and spaced above said carrier to thereby define an exit opening for the material web to pass through; and means for sealing the opening to confine air flow within said conductor.

25. Apparatus as set forth in claim 24 wherein said sealing means includes a seal roll rotatably mounted about an axis generally parallel to said edge and in proximate relationship and generally coextensive with the exit opening; means pivotally mounting said seal roll for rolling engagement with the material web as it exits on said carrier from said downstream zone.

26. Apparatus as set forth in claim 25 including counterbalance weight means operatively associated with said seal roll, said counterbalance weight means being adjustable for selectively altering the pressure of said seal roll applied against the material web.

27. Apparatus as set forth in claim 16 including a frame and wherein said distributor means includes a pair of stationary end members on said frame at the opposite ends of said drum and having cavities in communication with the interior of said drum, said drum and said end members defining a receptacle for temporarily containing the air-borne stream therein; and wherein said drum has an interior surface, support means on said frame mounting said rush roll for rotation about an axis generally parallel to the longitudinal axis of said drum; and fastener means releasably fixing said means to said frame for selectively repositioning said brush roll relative to said interior surface while maintaining said brush roll parallel with the axis of said drum.

28. Apparatus as set forth in claim 16 wherein said distributor means includes;

a pair of said drums in side-by-side relationship rotatable about substantially parallel longitudinal axes;

a pair of stationary end members mounted at opposite ends of each of said drums and having cavities in communication with the interior of its associated said drum; and means connecting the cavities of associated ones of said end members positioned in side-by-side relationship enabling continuous circuitous flow of the air-borne stream through said drums and the cavities of said end members.

29. Apparatus as set forth in claim 16 wherein said distributor means includes;

a pair of said drums in side-by-side relationship rotatable about substantially parallel longitudinal axes;

a pair of stationary end members mounted at opposite ends of each of said drums and having cavities in communication with the interior of its associated said drum; means connecting the cavities of associated ones of said end members positioned in side-by-side relationship enabling continuous circuitous flow of the air-borne stream of the roughly graded material through said drums and the cavities of said end members; and said nit removal conduit being arrayed for returning to said supply means the roughly graded material which has not advanced through the classification apertures.

30. Apparatus as set forth in claim 29 wherein said nit removal conduit includes:

a conduit extending between one of a pair of said end members and said supply means for permitting air flow therebetween; and flow generating means operatively associated with said conduit for drawing air-borne roughly graded material from the cavity of each of said one of a pair of end members and returning the roughly graded material to said supply means.

31. Distributor means for forming an air laid web of material having predetermined characteristics and where said means is supplied roughly graded material on a translating foraminous carrier comprising:

a pair of spaced apart cup-shaped stationary end members axially aligned and having cavities facing towards each other;

a cylindrical drum rotatably mounted between said end members, coaxial therewith, and generally having the same diameter as said end memers, said drum and said end members together defining a receptacle for temporarily containing said roughly graded material therein in an air-borne stream, said drum having a plurality of classification apertures extending therethrough around the circumference thereof to act as a first fine grading means and being of a predetermined shape, number, and size as specifically related to the types of the material introduced to said receptacle to produce said web of predetermined characteristics;

inlet means operatively associated with one of said end members for introducing the air-borne stream of roughly graded material into said receptacle;

a rotatable brush roll mounted within said receptacle and having an axis generally parallel to the axis of said drum;

a plurality of wire-like members extending radially outwardly from said brush roll adapted to rotationally agitate the air-borne stream of roughly graded material within said receptacle upon rotation of said brush roll and arranged to direct the flow of said first finely graded material through the classification apertures; and air flow producing means causing the first finely graded material to become a directionalized air-borne stream whereby predetermined shapes and sizes of the first finely graded material are arrested on said translating carrier resulting in a second finely graded material web of predetermined characteristics.

32. A distributor unit as set forth in claim 31 wherein the outlet apertures are rectangular shaped slots located at regularly spaced intervals both axially and circumferentially.

33. A distributor unit as set forth in claim 31 wherein the outlet apertures are round holes located at regularly spaced intervals both axially and circumferentially.

34. A distributor unit as set forth in claim 31 wherein the outlet apertures are rectangular slots located at regularly spaced intervals both axially and circumferentially and having an axial dimension substantially greater than a circumferential dimension.

35. A distributor unit as set forth in claim 31 wherein the outlet apertures are rectangular slots located at regularly spaced intervals around the circumference of said drum and staggered relative to one another in the axial direction and having an axial dimension substantially greater than a circumferential dimension.

36. A distributor unit as set forth in claim 31 wherein said drum and said brush roll are rotatable in opposite directions.

37. A distributor unit as set forth in claim 31 including a stationary frame and wherein said receptacle has an inner surface;

bearing means mounted on said frame for rotatably mounting said shaft at spaced apart locations; and fastening means for releasably mounting said bearing means to said frame to selectively position said shaft at a plurality of positions relative to said inner surface and parallel to the axis of said drum.

38. Apparatus as set forth in claim 12 wherein said distributor means is positioned above the carrier and includes an air-borne stream receiving inlet connected to said supply means, and wherein said tumbler means includes a cylindrical drum adapted to receive the air-borne stream from said inlet, said drum being rotatable about its longitudinal axis, and wherein said agitating means includes a rotatable brush roll extending within said drum and having an axis generally parallel to the axis of said drum, a rotatable brush roll extending within said drum along an axis generally parallel to the axis of said drum, a plurality of wire-like members bent into a u-shape having a pair of generally parallel spaced apart legs and bight portion connecting said legs generally midway between the ends thereof;

a plurality of elongated mounting blocks, each of said mounting blocks having a generally flat surface on one side and a longitudinal recess on an opposite side extending substantially the length thereof and a plurality of holes extending therethrough between said flat surface and said recess, adjacent pairs of the holes adapted to receive therethrough said legs of said wire-like members, said bight portion being received within said recess such that said legs extend in a direction away from said flat surface; and fastening means for mounting said blocks on the outer peripheral surface of said roll at substantially equally spaced circumferential locations such that the longitudinal axes of said blocks are substantially parallel to the longitudinal axis of said brush roll, said legs extending generally radially outwardly from said brush roll;

said wire-like members extending radially outwardly from said brush roll adapted to rotationally agitate the air-borne stream of roughly graded material within said drum and arranged to direct the flow of first finely graded material outwardly through the classification apertures.

39. A distributor unit for forming an air laid web of material having predetermined characteristics and where said means is supplied roughly graded material on a translating foraminous carrier comprising:

first and second pairs of spaced apart cup-shaped stationary end members, each of said pairs being axially aligned and each of said end members having a cavity facing towards the cavity of the other of said end members, said first and second pairs being disposed along parallel axes, one of said end members being an upstream end member and one of said end members being a downstream end member, said upstream end member of said first pair positioned adjacent said downstream end member of said second pair, said downstream end member of said first pair positioned adjacent said upstream end member of said second pair;

first and second cylindrical drums rotatably mounted, respectively, between said first and second pairs of end members, coaxial therewith, and generally having the same diameter as said end members, said drums and said end members defining, respectively, first and second receptacles for temporarily containing roughly graded material supported therein in an air-borne stream, each of said drums having a plurality of classification apertures extending therethrough around the circumference thereof being of a predetermined shape, number, and size as specifically related to the types of fibers and/or particles introduced to said respective receptacle, said receptacles enclosing upper regions and lower regions;

inlet means operatively associated with said upstream end member for each of said pairs thereof for introducing an air-borne stream of the roughly graded material into said respective receptacle for flow towards said downstream end member;

a rotatable brush roll mounted within each of said first and second receptacles and having an axis generally parallel to the axis of said respective drum;

a plurality of wire-like members extending radially outwardly from each of said brush rolls adapted to rotationally agitate the fibers within said first and second receptacles upon rotation of each said respective brush roll and arranged to direct the flow of first finely graded material through the classification apertures;

a first chute member connecting the upper regions within said first receptacle at said downstream end member of said first pair thereof with the lower regions within said second receptacle at said upstream end member of said second pair thereof;

a second chute member connecting the upper regions within said second receptacle at said downstream end member of said second pair thereof with the lower regions within said first receptacle at said upstream member of said first pair thereof; and said first and second chute members enabling continuous circuitous flow of the air-borne stream of roughly graded material through said first and second receptacles.

40. A distributor unit as set forth in claim 39 including a nit removal means operatively associated with each of said downstream end members for removing from said first and second receptacles roughly graded material which has not advanced through the classification apertures.

41. In combination with a distributor unit as set forth in claim 40:

supply means for introducing into said inlet means an air-borne stream of roughly graded material and wherein said withdrawal means includes:

a conduit extending between each of said downstream end members and said supply means for permitting air flow therebetween; and flow generating means operatively associated with said conduit for drawing roughly graded material from the cavity of each of said downstream end members and returning them to said supply means.

42. Blending apparatus for mixing roughly graded material of at least one of first and second types of loose fibers and particles into a homogeneous mixture in preparation for introducing the roughly graded material to air forming apparatus comprising:

a cylindrical container for confining a stream of air flowing between an inlet end and an outlet end;

a pair of inlet ducts communicating with said container for introducing the roughly graded material into said container, said inlet ducts being angularly disposed relative to said container so as to direct flow of the roughly graded material toward said outlet end;

a cone shaped container having major and minor ends and integrally mounted at its major end to said outlet end for receiving and homogeneously mixing the roughly graded material in the stream of air; and blower means mounted to said minor end of said conical shaped container to receive therefrom for further mixing the air supported mixture of the roughly graded material and for conveying the air supported mixture of the roughly graded material to the air forming apparatus.

43. In apparatus for producing an air laid web of material having predetermined characteristics comprising:

a translating foraminous carrier;

a distributor unit positioned above the carrier having inlet means for receiving an air-borne stream of roughly graded material and outlet means for directing flow of the air-borne stream outwardly thereof;

means for redirecting portions of the air-borne stream which flow outwardly of said distributor unit to cause them to flow downwardly onto the surface of the carrier to form a homogeneous web of material;

an air flow conductor surrounding said distributor unit for directing ambient air across said distributor unit and through said carrier, said conductor extending between an open enlarged end and an open reduced end, said reduced end extending across said carrier adjacent thereto and having an edge extending transverse to said carrier at a downstream zone at which said carrier moves beyond said reduced end, said edge being generally parallel to the surface of said carrier and spaced above said carrier by a sufficient distance to thereby define an exit opening for the web of material to pass through;

the improvement comprising:

a cylindrical seal roll extending transverse to the direction of movement of said carrier and generally coextensive with and proximate to the exit opening for confining air flow within said conductor;

means rotatably mounting said seal roll about an axis generally parallel to said edge; and journal means pivotally mounting said seal roll for movement transverse of said carrier; and adjustable biasing means for controlling the pressure applied by said seal roll against the web of material formed on said carrier proximate to said edge.

44. Apparatus as set forth in claim 43 wherein said biasing means includes adjustable counterbalance means for selectively adjusting the pressure of said seal roll on the web of material.

* * * * *

UNITED STATES PATENT AND TRADEMARK OFFICE

CERTIFICATE OF CORRECTION

PATENT NO. : 4,640, 810

DATED : February 3, 1987

INVENTOR(S) : Henning Laursen, John Mosgaard, Otto V. Nielson, Clark L. Poland

It is certified that error appears in the above—identified patent and that said Letters Patent is hereby corrected as shown below:

Line 14 of the Abstract, "alternations" should read --alterations--.

Column 2, line 14, "generating" should read --operating--.

Column 3, line 23, "These" should read --There--.

Column 6, line 67, "result" should read --shaft--.

Column 7, line 46, "flox" should read --flow--.

Column 11, line 4, "shaped" should read --spaced--.

Column 22, line 34, "tumber" should read --tumbler--.

Column 24, line 25, "rush" should read --brush--;

line 27, "bearing" should be inserted after "said" first occurrence.

Signed and Sealed this

Fifteenth Day of September, 1987

*Attest:*

*Attesting Officer*

DONALD J. QUIGG

*Commissioner of Patents and Trademarks*